United States Patent [19]

Smith et al.

[11] Patent Number: 4,926,756

[45] Date of Patent: May 22, 1990

[54] LONGITUDINAL STEERING LINKAGE FOR TRUCK WITH INTERAXLE YOKES

[75] Inventors: Roy E. Smith, Kingston; Peter E. Timan, Sydenham, both of Canada

[73] Assignee: UTDC Inc., Kingston, Canada

[21] Appl. No.: 407,677

[22] Filed: Aug. 31, 1989

Related U.S. Application Data

[63] Continuation of Ser. No. 327,375, Mar. 23, 1989, abandoned, which is a continuation of Ser. No. 78,742, Jul. 28, 1987, abandoned.

[51] Int. Cl.[5] ..... B61F 3/00

[52] U.S. Cl. ..... 105/167; 105/199.1

[58] Field of Search ..... 105/168, 167, 165, 199.1

[56] References Cited

U.S. PATENT DOCUMENTS

| | | | |
|---|---|---|---|
| 424,089 | 3/1890 | Bosdevex | 105/168 |
| 3,828,692 | 8/1974 | Kreissig | 105/165 |
| 4,170,179 | 10/1979 | Vogel | 105/168 |

FOREIGN PATENT DOCUMENTS

| | | | |
|---|---|---|---|
| 2141370 | 7/1980 | Fed. Rep. of Germany | 105/165 |
| 2603012 | 2/1988 | France . | |
| 8706550 | 11/1987 | Switzerland . | |
| 689048 | 3/1953 | United Kingdom | 105/168 |

*Primary Examiner*—Margaret A. Focarino
*Assistant Examiner*—Joseph D. Pape
*Attorney, Agent, or Firm*—Rogers, Bereskin & Parr

[57] ABSTRACT

This invention applies the linkage connected between the interaxle yokes of a truck and a railroad vehicle car body so as to create radially steered alignment of wheelsets on circular curves without reference to the truck frame. Forces exchanged between the wheelsets and the car body are essentially longitudinal and no significant lateral forces are created on the truck frame or car body from the steering action. The steering linkage utilizes the longitudinal component of relative motion of a point on the car body with reference to the vehicle truck to cause relative pivotal movement of the interaxle yokes thereby guiding the wheelsets to a radial alignment. Radial alignment is achieved by suitable proportioning of the links of the mechanism.

4 Claims, 3 Drawing Sheets

LONGITUDINAL STEERING LINKAGE FOR TRUCK WITH INTERAXLE YOKES

This is a continuation of application Ser. No. 07/327,375 now abandoned which was a continuation of application Ser. No. 07/078,742 now abandoned.

This invention relates to railway vehicles having trucks which are equipped with wheelsets which are pivotally mounted to the truck. The wheelsets are guided to a radial alignment during travel of the railway vehicle along circular curved track.

Railway trucks having steerable axles to achieve radial alignment are well-known in the art. Various mechanisms have been provided to steer the axles to a radial alignment.

In some trucks equipped for radial alignment of the wheelsets each wheelset is mounted in a steering yoke. The yokes are interconnected. Typically these mechanisms make use of the yaw motion of the car body relative to the truck center line to create the steering motions. In such trucks, forces are created in a lateral direction on the outboard yoke and reacted through a reference link and lateral link to the truck side frame. In experience it has been found that the mechanical advantage of this system demanded the production of relatively large forces in order to generate the required steering motions and maintain them against the influences of wheel/rail forces, particularly those acting at the flange of the wheels when flange rail contact occurs and also the oscillatory forces generated during hunting. The stiffness, which can be designed into these type of components making up the mechanical linkage, is usually such that steering accuracy is inadequate and stability against hunting oscillations is unsatisfactory.

A new linkage has been developed to overcome these deficiencies. According to the new linkage steering motions are created without utilization of the truck frame for any pivotal connections.

The steering mechanism of this invention may be mounted on an existing truck having axles mounted in interconnected yokes. The mechanism is offset laterally from the center line of the truck. It is advantageous to offset the mechanism as far as practical.

According to the invention there is provided a steering mechanism for use on a railway vehicle having a car body mounted on at least two trucks. At least one of the trucks has inboard and outboard wheelsets, each of the wheelsets being mounted in a yoke. The inboard and outboard yokes are pivotally interconnected. Each of the wheelsets is affixed to the truck in such a manner as to be adapted for relative pivotal movement with respect to the truck about a general vertical axis. The mechanism further includes a steering mechanism for guiding the wheelsets to a radial alignment when the vehicle is travelling on circular curved track. The mechanism comprises a steering link connected to the car body and a steering lever which is pivotally connected to the steering link. A linkage mechanism interconnects the steering lever and the inboard and outboard yokes whereby relative longitudinal movement of the car body/steering link connection point with respect to the truck when moving from tangent track to circular track causes relative and opposite pivotal movement of the inboard and outboard yokes whereby the wheelsets assume a radial configuration when on curved track.

A more complete understanding of the invention may be had by reference to the attached drawings and description which illustrate preferred embodiments of the invention and in which.

When a railroad vehicle moves from tangent track to circular curved track there is relative rotation between the car body and the trucks supporting the car body typically at either end of the railroad vehicle. In view of the relative rotation of the truck and car body, a point remote from the center line of the car body will appear to move in the longitudinal direction with reference to the truck as well as having slight motion in the lateral direction. The longitudinal component of such motion is directly related to the radius of curvature and is used in this invention as the steering input to guide the wheelsets to a radial configuration.

Generally speaking, the mechanism may be mounted on typical wheelset yokes and is offset laterally from the center line of the truck as far as practical. A bracket may be attached to the outboard yoke which bracket carries the lower pivot for a vertical steering lever which is thereby connected to it. At a point on the steering lever, intermediate between its upper and lower ends, a steering rod is connected to the bracket by means of a pivotal connection and this steering rod is similarly attached to the inboard yoke through a bracket carrying a pivot connection. The top of the steering lever is connected to a longitudinal steering link through a pivot connection and the other end of that link is connected to the car body.

As the car body swivels relative to the truck the steering link is moved fore and aft relative to points on the truck, thus pivoting the steering lever and forcing the yokes apart or together. Because the yokes are pinned together at the center of the truck, the action of the steering mechanism is to cause the wheelset/yoke assemblies to rotate relative to one another into a steered alignment. Correct proportioning of the lever ratio ensures that true radial alignment is achieved on circular curves.

Figure 1:
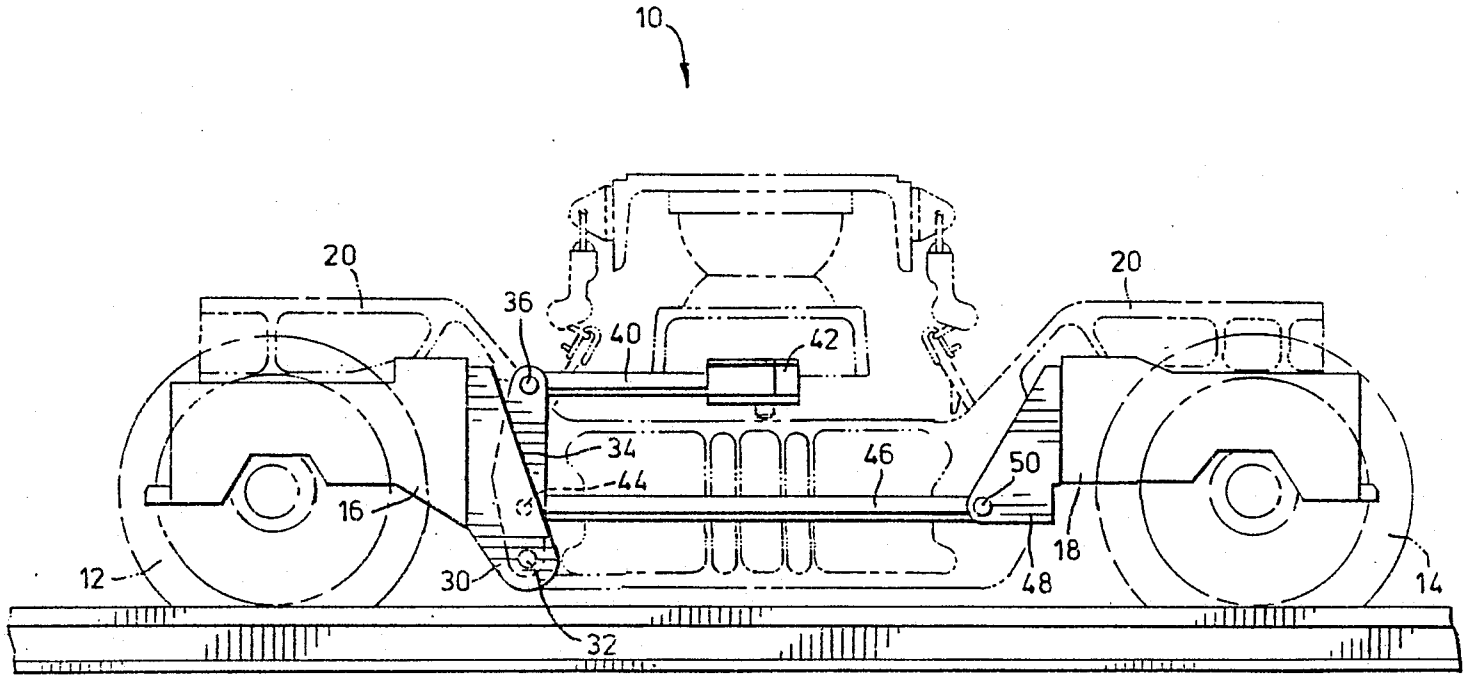
FIG. 1 is a section on line 1—1 of FIG. 2 illustrating in side view, a truck incorporating a preferred embodiment of the steering mechanism of this invention.
Figure 2:
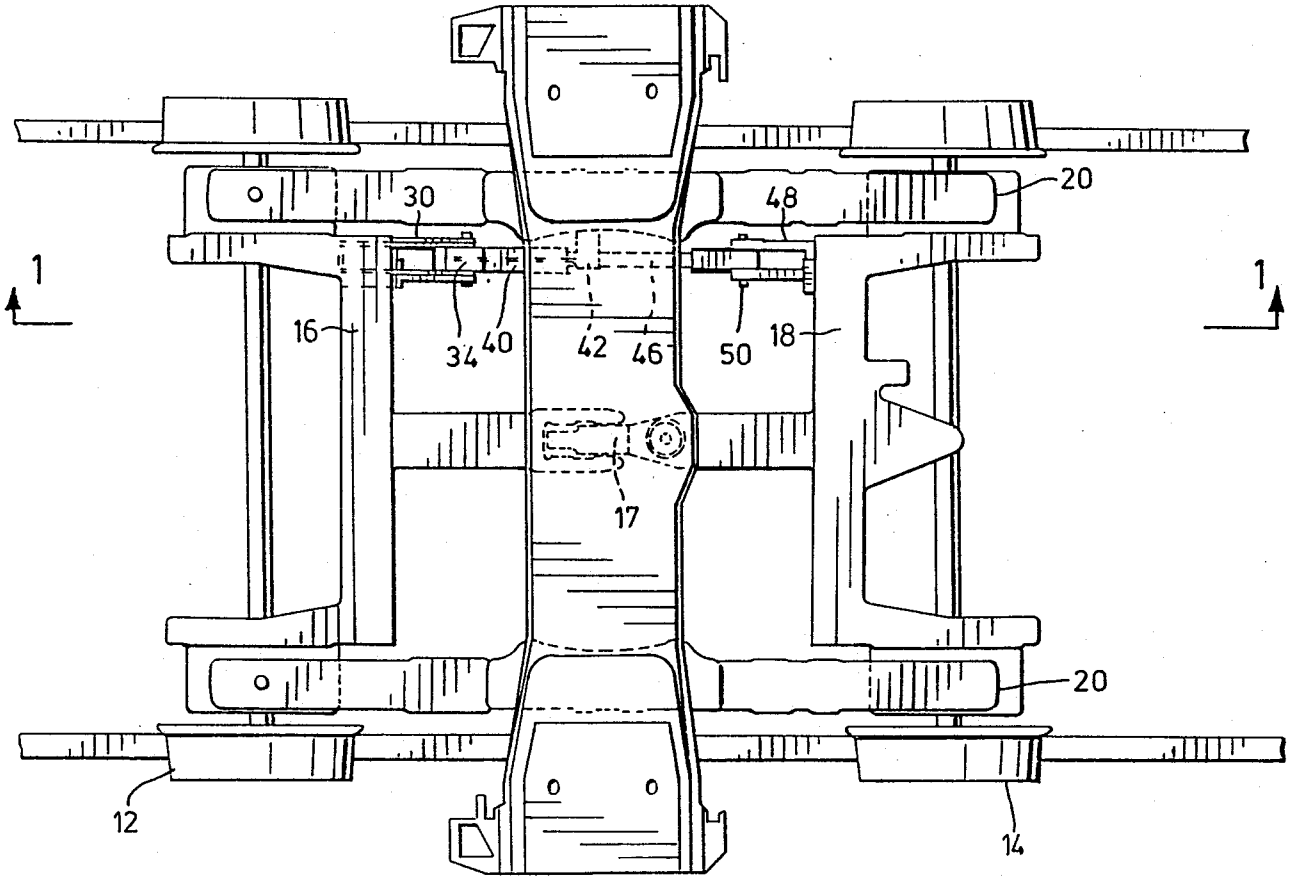
FIG. 2 illustrates, in plan view, the truck of FIG. 1 with the steering mechanism of this invention in the position for negotiating tangent track.
Figure 3:
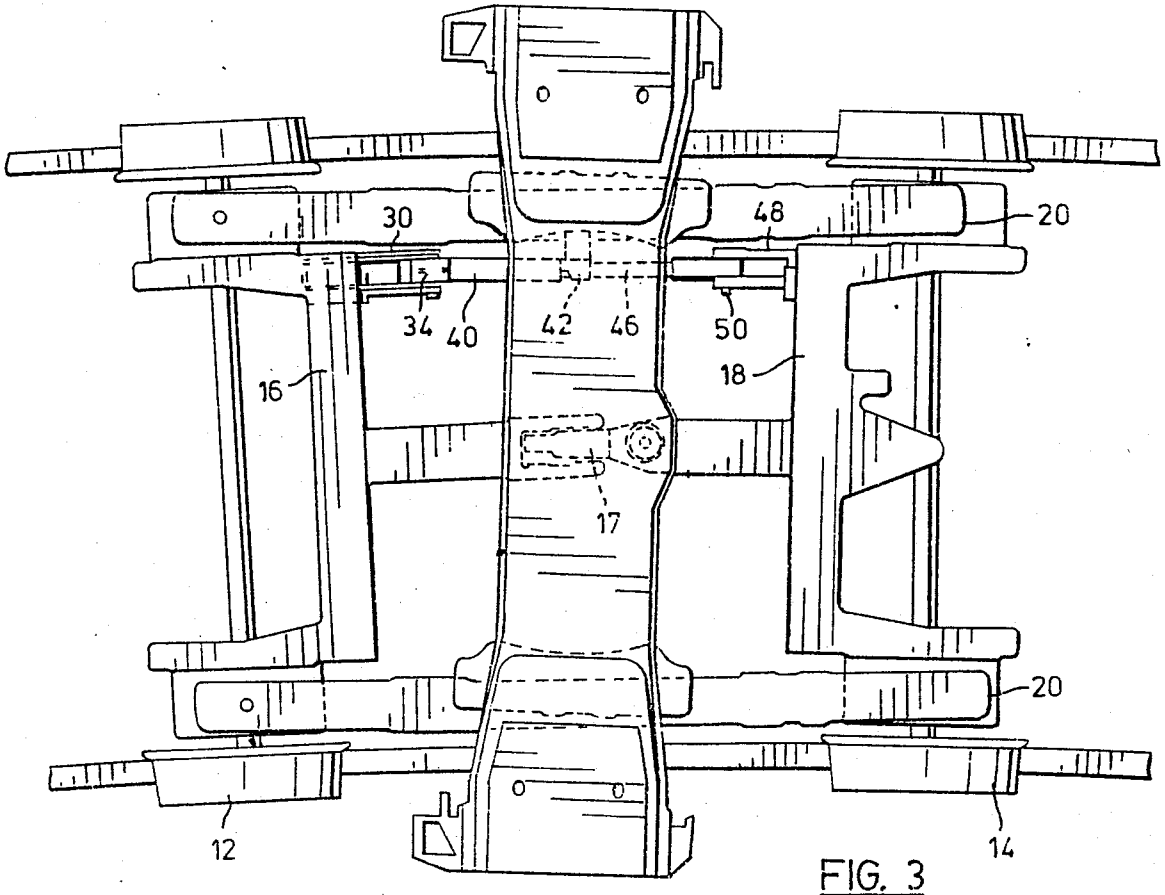
FIG. 3 illustrates, in plan view, the truck of FIG. 1 with the steering mechanism of this invention in the position for negotiating curved track.

FIG. 1 illustrates a truck generally at 10 having a steering mechanism according to this invention installed thereon. The truck comprises an outboard wheelset 12 and an inboard wheelset 14. Each wheelset, as will be understood by those familiar with railroad art, comprises an axle and a pair of flanged conical wheels fixed thereto such that the axle and wheels turn at the same radial speed. Such conical wheelsets if permitted appropriate freedom will move to a radial configuration when travelling on curved tracks. However, as also well understood by those familiar with this art, such single wheelsets are unstable and will continue to hunt when travelling on either tangent track or on curved track.

In the truck 10 as illustrated in FIG. 1 the wheelsets are mounted in yokes. The outboard yoke is indicated at 16 and the inboard yoke at 18. The truck frame is indicated generally at 20.

A bracket 30 is attached to outboard yoke 16. The bracket 30 comprises a pivotal connection 32 at a convenient portion of the bracket. A substantially vertical steering lever 34 is pivotally connected to bracket 30 at pivotal connection 32. The steering lever 34 has a pivotal connection 36 at its upper end. A steering link 40 is pivotally connected to steering lever 34 at the pivotal connection 36. The steering link 40 is attached to the ca body, which is not illustrated, at connection 42.

The bracket 30, steering lever 34 and steering link 40 are all located laterally as remote as possible from the center line of the vehicle. The location of the steering mechanism is dictated by the configuration of the truck frame, the yokes and the configuration of bracket 30. The advantage of having the mechanism remote as far as possible from the center line is that larger motions are available for more accurate steering inputs.

The steering lever 34 has a pivotal connection 44 which is intermediate the pivotal connections 32 and 36. A steering rod 46 is pivotally connected to the steering lever 34 at pivotal connection 44. The steering rod 46 is pivotally connected to a bracket 48 at pivotal connection 50. Bracket 48 is affixed to the inboard steering yoke 18.

The outboard steering yoke 16 and the inboard steering yoke 18 are pivotally connected to each other at 17 for relative pivotal movement.

With respect to the Figure it may be appreciated that the connection 42 will move longitudinally as the truck pivots with respect to the car body. Assuming that the connection 42 moves to the left in the Figure, the steering lever 34 will be caused to pivot about the pivotal connection 32. This in turn causes the steering rod 46 to be drawn to the left with respect to the pivotal connection 32. Thus, on this side of the truck the two wheels illustrated of wheelsets 12 and 14 respectively will be moved towards each other and thus accomplish a turn with the center of curvature in front of the sheet. Similarly movement in the other direction will cause the wheels illustrated in the drawing to move further apart accomplishing a turn in the direction with the radius of curvature behind the sheet.

It will be obvious to those skilled in the art that the mechanism may be duplicated on either side of the truck to provide a redundant steering mechanism.

Various other modifications and changes will occur to those skilled in the art without departing from the scope of the invention as defined in the attached claims.

We claim:

1. A steering mechanism for use on a railway vehicle having a car body mounted on at least two trucks, at least one of said trucks having inboard and outboard wheelsets, and a truck frame, each of said wheel-sets having a steering yoke attached thereto, each said steering yoke having a generally C shaped configuration and extending laterally from adjacent one wheel of a wheelset to adjacent the opposite wheel of the wheelset, each said steering yoke further extending inwardly toward the other yoke of said truck and the two side yokes having a pivotal interconnection, said wheelsets supporting said truck and adapted for relative pivotal movement with respect to said truck about a generally vertical axis and, a steering mechanism for guiding said wheelsets to a radial alignment when said vehicle is travelling on circular curved track, said steering mechanism being independent of any direct pivotal connections to said truck frame, said steering mechanism comprising, a steering link connected to said car body remote from the longitudinal center line of said car body, a steering lever pivotally connected to said steering link, and linkage mechanism interconnecting said steering lever and said inboard and outboard yokes whereby longitudinal movement of the connection between said steering link and said car body with respect to said truck when said truck rotates with respect to said body guides said wheelsets to a radial alignment.

2. The steering mechanism of claim 1 wherein said steering mechanism further comprising a pivotal connection between said steering lever and said outboard wheelset, said steering lever having a further pivotal connection intermediate said pivotal connection between said steering lever and said steering link and the pivotal connection between said steering lever and said outboard yoke, a steering rod pivotally linked to said steering lever at said further pivotal connection, said steering rod pivotally linked to said inboard yoke.

3. The device of claim 2 wherein said steering lever is connected to said outboard wheelset by means of a bracket affixed to said yoke, said bracket having a pivotal connection to said steering lever.

4. The device of claim 3 wherein said steering rod is connected to said inboard yoke by means of a bracket fixed to said yoke said bracket having a pivotal connection to said steering rod.

* * * * *